US011701567B2

(12) United States Patent
Tsai

(10) Patent No.: US 11,701,567 B2
(45) Date of Patent: Jul. 18, 2023

(54) WIRELESS ELECTRONIC TABLE GAME SCOREBOARD

(71) Applicant: Medal Sports (Taiwan) Corporation, Taipei (TW)

(72) Inventor: Kevin Chunhao Tsai, Kaohsiung (TW)

(73) Assignee: MEDAL SPORTS (TAIWAN) CORPORATION, Taipei (TW)

( * ) Notice: Subject to any disclaimer, the term of this patent is extended or adjusted under 35 U.S.C. 154(b) by 85 days.

(21) Appl. No.: 17/029,367

(22) Filed: Sep. 23, 2020

(65) Prior Publication Data

US 2021/0001206 A1 Jan. 7, 2021

Related U.S. Application Data

(62) Division of application No. 15/166,787, filed on May 27, 2016, now Pat. No. 10,828,552.

(51) Int. Cl.

| | |
|---|---|
| ***A63B 71/06*** | (2006.01) |
| ***A63B 63/08*** | (2006.01) |
| ***A63F 7/30*** | (2006.01) |
| ***A63F 7/06*** | (2006.01) |
| ***A63B 67/04*** | (2006.01) |

(Continued)

(52) U.S. Cl.

CPC ..... *A63B 71/0669* (2013.01); *A63B 63/083* (2013.01); *A63B 67/04* (2013.01); *A63F 7/0612* (2013.01); *A63F 7/0664* (2013.01); *A63F 7/307* (2013.01); *A63B 24/0062* (2013.01); *A63B 67/06* (2013.01); *A63B 69/00* (2013.01); *A63B 69/002* (2013.01); *A63B 69/0024* (2013.01); *A63B 69/0046* (2013.01); *A63B 71/022* (2013.01); *A63B 71/0622* (2013.01); *A63B 2024/0037* (2013.01); *A63B 2063/001* (2013.01); *A63B 2071/0625* (2013.01); *A63B 2102/16* (2015.10); *A63B 2210/50* (2013.01); *A63B 2220/53* (2013.01); *A63B 2220/62* (2013.01); *A63B 2220/801* (2013.01); *A63B 2220/802* (2013.01); *A63B 2220/805* (2013.01); *A63B 2220/806* (2013.01); *A63B 2225/50* (2013.01)

(58) Field of Classification Search

CPC ..... A63B 71/0669; A63B 24/0062; A63B 63/083

See application file for complete search history.

(56) References Cited

U.S. PATENT DOCUMENTS

2008/0254866 A1* 10/2008 Young ..... A63B 71/0622 463/25

2009/0048044 A1* 2/2009 Oleson ..... A43B 5/00 473/570

(Continued)

*Primary Examiner* — Jeffrey S Vanderveen

(74) *Attorney, Agent, or Firm* — Dickinson Wright PLLC

(57) ABSTRACT

A method of operating an electronic basketball scoreboard apparatus is disclosed. The method includes receiving a game parameter; operating a basketball game based upon the received game parameter; receiving a first indication of a ball passing through a first basketball hoop; receiving a second indication of a ball passing through a second basketball hoop; determining a first score of the basketball game based on the first indication from the first score sensor; determining a second score of the basketball game based on the second indication from the second score sensor; recording video of the basketball game; transmitting the recorded video; and transmitting the first score and the second score.

20 Claims, 8 Drawing Sheets

(51) Int. Cl.

| | |
|---|---|
| ***A63B 24/00*** | (2006.01) |
| ***A63B 71/02*** | (2006.01) |
| ***A63B 67/06*** | (2006.01) |
| ***A63B 102/16*** | (2015.01) |
| ***A63B 69/00*** | (2006.01) |
| ***A63B 63/00*** | (2006.01) |

(56) References Cited

U.S. PATENT DOCUMENTS

| | | | | |
|---|---|---|---|---|
| 2011/0231428 | A1* | 9/2011 | Kuramura | G06Q 30/00 707/769 |
| 2015/0265897 | A1* | 9/2015 | Gordon | A63B 63/083 473/447 |
| 2016/0016041 | A1* | 1/2016 | Giedwoyn | G16H 20/30 700/91 |
| 2016/0322078 | A1* | 11/2016 | Bose | A63B 24/0003 |

* cited by examiner

WIRELESS ELECTRONIC TABLE GAME SCOREBOARD

CROSS REFERENCE TO RELATED APPLICATIONS

This Application is a Divisional Application of U.S. patent application Ser. No. 15/166,787, filed on May 27, 2016, the content of which is incorporated by reference herein in its entirety.

BACKGROUND

Traditional table games, such as basketball table games (e.g., Pop-A-Shot®), are limited in a number of ways. For instance, table games are limited by configuration: the tables are, more often than not, configured solely for one particular game. Table games are also limited by the nature of the particular game: the user is not able to play other kinds of games on a particularly configured table. For example, with a basketball table game that is particularly configured, the user may be limited to a pre-defined game type (e.g., total baskets made by one player) for a pre-defined time limit (e.g., one minute). The user may characterize particularly configured table games as unenjoyable, old-fashioned, and boring. It is difficult, if not impossible, for the user to modify a table game for enjoyable, creative, and new types of games. Likewise, it is difficult, if not impossible, for the user to envision combining different game sets to create entirely new games, with entirely new sets of rules. For these reasons, the user may have to settle for one particular game configuration.

Additionally, traditional table games have implemented rudimentary user controls. The user may have the ability to turn on/off the table game, and perform other basic functions (e.g., possibly toggle through a few game modes). However, traditional table games have not provided the user with a level of customization and a technical user interface that is expected in modern-day products. For example, though many products have improved connectivity with personal electronic devices (e.g., the user's cell phone), traditional table games have not yet implemented this improved connectivity.

SUMMARY

The present disclosure relates generally to a wireless electronic table game scoreboard. More particularly, a table game scoreboard is configured to provide game parameters to a connected user device and receive selected game parameters from the connected user device. The table game scoreboard is further configured to create a table game, to be played by the user, incorporating the selected game parameters. In this way, the scoreboard provides for new and creative variations of current games.

In an example embodiment, an electronic basketball scoreboard includes a data transmission module, a game execution module, a camera, an electronic display, and a plurality of score sensors. The data transmission module is in communication with a user device. The game execution module is in communication with the data transmission module. The camera is in communication with the game execution module. The electronic display is in communication with the game execution module. The plurality of score sensors are in communication with the game execution module. The data transmission module is configured to provide a plurality of game parameters to the user device.

The data transmission module is further configured to receive a plurality of selected game parameters from the user device. The plurality of selected game parameters include at least a game type and a time limit. The data transmission module is further configured to send the plurality of selected game parameters to the game execution module. The game execution module creates a basketball game, to be played by the user, which incorporates the plurality of selected game parameters, such that the basketball game played is defined by the game type and played for a duration defined by the time limit.

In another example embodiment, a method of wirelessly controlling an electronic scoreboard includes connecting a user device to an electronic scoring system. The method includes receiving, by the user device, a plurality of game parameters from the electronic scoring system. The method includes displaying, by the user device, the plurality of game parameters. The method includes receiving, by the user device, a game type selected by the user on the user device. The method includes receiving, by the user device, a time limit selected by the user on the user device. The method includes sending the game type and the time limit from the user device to the electronic scoring system. Responsive to receiving the game type and the time limit from the user device, the method includes creating, by the electronic scoring system, a game. Creating the game includes starting a game timer that expires at the time limit. Creating the game further includes, recording a video, and allowing the user to play the game defined by the game type. Responsive to the game timer expiring at the time limit, the method further includes ending the game including ceasing video recording.

In yet another example embodiment, an electronic scoring system includes a data transmission module, configured to communicate with a user device. The electronic scoring system includes a game execution module, in communication with the data transmission module. The electronic scoring system includes a plurality of score sensors, in communication with the game execution module.

Additional features and advantages of the disclosed method and apparatus are described in, and will be apparent from, the following Detailed Description and the Figures.

BRIEF DESCRIPTION OF THE FIGURES

The features, objects, and advantages of the present disclosure will become more apparent from the detailed description set forth below when taken in conjunction with the drawings in which like reference characters identify correspondingly throughout and wherein.

DETAILED DESCRIPTION

Figure 1:
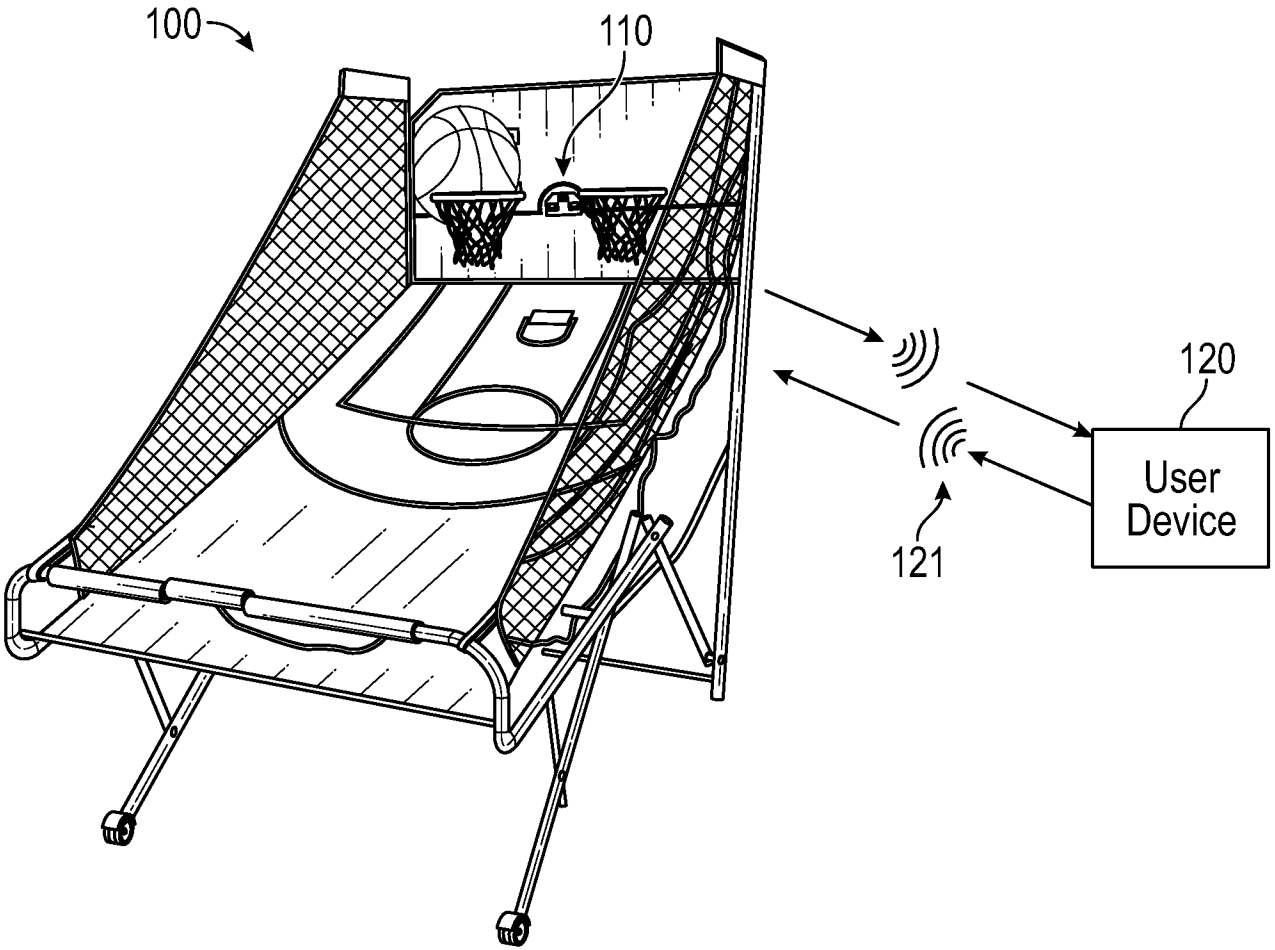
FIG. 1 shows a diagram of an example table game apparatus, according to an example embodiment of the present disclosure.

As used herein, the terms "a" or "an" shall mean one or more than one. The term "plurality" shall mean two or more than two. The term "another" is defined as a second or more. The terms "including" and/or "having" are open ended (e.g., comprising). The term "or" as used herein is to be interpreted as inclusive or meaning any one or any combination. Therefore, "A, B or C" means "any of the following: A; B; C; A and B; A and C; B and C; A, B and C". An exception to this definition will occur only when a combination of elements, functions, steps or acts are in some way inherently mutually exclusive.

Reference throughout this document to "one embodiment," "certain embodiments," "an embodiment," or similar term means that a particular feature, structure, or characteristic described in connection with the embodiment is included in at least one embodiment. Thus, the appearances of such phrases in various places throughout this specification are not necessarily all referring to the same embodiment. Furthermore, the particular features, structures, or characteristics may be combined in any suitable manner on one or more embodiments without limitation.

Table Game Apparatus

As discussed above, typical table games have limited configurations, rudimentary user controls, and generally lack the capability for user customization. The example systems and methods disclosed herein solve at least some of the above described issues by providing the user with the ability to configure and customize games in ways previously unavailable. For example, the user is provided the capability to select and configure particular game types and particular game parameters (e.g., time limit, player name, etc.) to customize gameplay via the user's personal device. Typically, table games have not provided connectivity with a user device, as disclosed herein. Information provided by the electronic scoring system to the user is organized and presented, in a user-friendly manner, by the third-party application running on the user device. In this way, the third-party application facilitates information exchange between the electronic scoring system and the user. By providing a wireless connection between the user device and the electronic scoring system, the user may interact with the electronic scoring system in ways previously not contemplated by table games.

The example systems and methods disclosed herein further provide the user with additional features, beyond mere gameplay. For example, the electronic scoring system may record a video of gameplay and provide the video to the user. The electronic scoring system may also edit the video to incorporate additional information associated with the user and the game, such that the video provided to the user is customized to the user's individual gameplay experience. In today's world, self-recorded videos are extremely popular; thus, users may appreciate additional features provided by the systems and methods disclosed herein, such as customized video of gameplay.

Referring now to the figures, FIG. 1 shows a diagram of an example table game apparatus 100, according to an example embodiment of the present disclosure. The table game apparatus 100 includes an electronic scoring system 110. The electronic scoring system 110 is in communication with a user device 120, via communication link 121. In an example embodiment, the user device 120 is a cell phone. In other example embodiments, the user device 120 may be any electronic device such as a tablet, personal computer, MP3 player, etc. In an example embodiment, the communication link 121 is a WiFi connection between the electronic scoring system 110 and the user device 120. The WiFi connection, as disclosed herein, is described in greater detail with reference to FIG. 6.

In other example embodiments, the communication link 121 may be any wireless communication link such as radio frequency, Bluetooth®, ZigBee®, near field communication (NFC), local LAN hotspot, server hotspot, Internet, etc. For example, a radio frequency wireless communication link may employ electromagnetic wave frequencies for communication (e.g., between the user device 120 and the electronic scoring system 110). In an example embodiment, initiating the communication link 121 via radio frequency includes communication between an antenna and a radio tuner. For example, the user device 120 may include the antenna and tuner, and may tune to a particular frequency band (as dictated by the electronic scoring system 110). Once tuned to the particular band, the user device 120 may receive information (e.g., electromagnetic waves) propagated by the electronic scoring system 110.

Likewise, for example, a Bluetooth® communication link may employ short wavelength radio waves between devices (e.g., between the user device 120 and the electronic scoring system 110). In an example embodiment, initiating the communication link 121 via Bluetooth® includes pairing the user device 120 and the electronic scoring system 110. For example, the electronic scoring system 110 may propagate a connection initiation request (e.g., master or initiator of the connection), which may be subsequently accepted by the user device 120 (e.g., slave or recipient of the connection). In an example embodiment, the master-slave relationship may be switched, such that the user device 120 propagates the connection initiation request, which may be subsequently accepted by the electronic scoring system 110.

Likewise, for example, a ZigBee® wireless communication link may employ a low-power personal area network via a digital radio (e.g., low-power connection between the user device 120 and the electronic scoring system 110). In an example embodiment, initiating the communication link 121 via ZigBee® includes establishing both a coordinator and an end device. For example, the user device 120 may be established as the coordinator. Likewise, for example, the electronic scoring system 110 may be established as the end device. Once these roles have effectively been defined, the coordinator (e.g., the user device 120) may establish a secure link with the external device (e.g., the electronic scoring system 110).

Likewise, for example, NFC may employ communications links (e.g., between the user device 120 and the electronic scoring system 110) at closer proximal distances (e.g., approximately two inches). In an example embodiment, initiating the communication link 121 via NFC includes proximity detection between a reader or initiator (e.g., the user device 120) and a target (e.g., the electronic scoring system 110). In proximity, the reader can receive information provided by the initiator. For example, when the user device 120 is in proximity to the electronic scoring system 110, the user device 120 may detect some type of information (e.g., a prompt to download a third-party application, instructions to sync a WiFi connection, etc.). Likewise, for example, NFC may be used to physically establish a WiFi connection. In this example, the reader (e.g., the user device 120) may physically detect a target (e.g., the electronic scoring system 110). Responsive to detection, the target may provide the reader with credentials (e.g., network details, password, etc.), such that the reader (e.g., user device 120) may manually and/or automatically connect to WiFi generated by the target (e.g., the electronic scoring system 110). Likewise, for example, when one of the devices to the communication link 121 has Internet (e.g., the user device 120) the other device (e.g., the electronic scoring system 110) may exchange data with online services. In this way, the electronic scoring system 110 may advantageously utilize Internet-enabled user devices.

In each of these example embodiments described above, the user device 120 may initiate communication link 121 and/or the electronic scoring system 110 may initiate communication link 121. In alternate example embodiments, multiple different wireless communication links may be employed for communication link 121. For example, the user device 120 may initiate communication link 121 with the electronic scoring system 110 via NFC to send primary information (e.g., game parameters); subsequently, the electronic scoring system 110 may initiate communication link 121 with user device 120 via WiFi to send secondary information (e.g., an overlay video).

The table game apparatus 100, as illustrated in FIG. 1, is configured for a basketball game. For example, the table game apparatus 100 may include side panels and a backboard panel. The side panels may include side boundary nets. The backboard panel includes at least one basketball rim. In an example embodiment, the basketball rim is hinged, such that it may fold flat and parallel with the backboard panel. The backboard panel additionally includes the electronic scoring system 110. The table game apparatus 100 may additionally include a plurality of supports configured to hold at least a portion of the table game apparatus 100 off the floor.

While the table game apparatus 100 disclosed above and discussed herein is configured for a basketball game, the table game apparatus 100 is in no way limited to basketball games. In other example embodiments, the table game apparatus 100 may be configured for other types of games such as any one of billiards, foosball, bumper billiards, air hockey, table tennis, target toss, pinball soccer, finger football, bowling, chess, checkers, Chinese checkers, backgammon, basketball toss, football toss, bean bag toss, etc. Likewise, an alternate example embodiment, the table game apparatus 100 may be configured to multi-game options (e.g., 6-in-1 or 20-in-1 gaming-table configurations). In alternate example embodiments, each of these configurations includes the electronic scoring system 110, in communication with user device 120, such that the user may customize and configure the table game apparatus 100 via user device 120.

Figure 2:
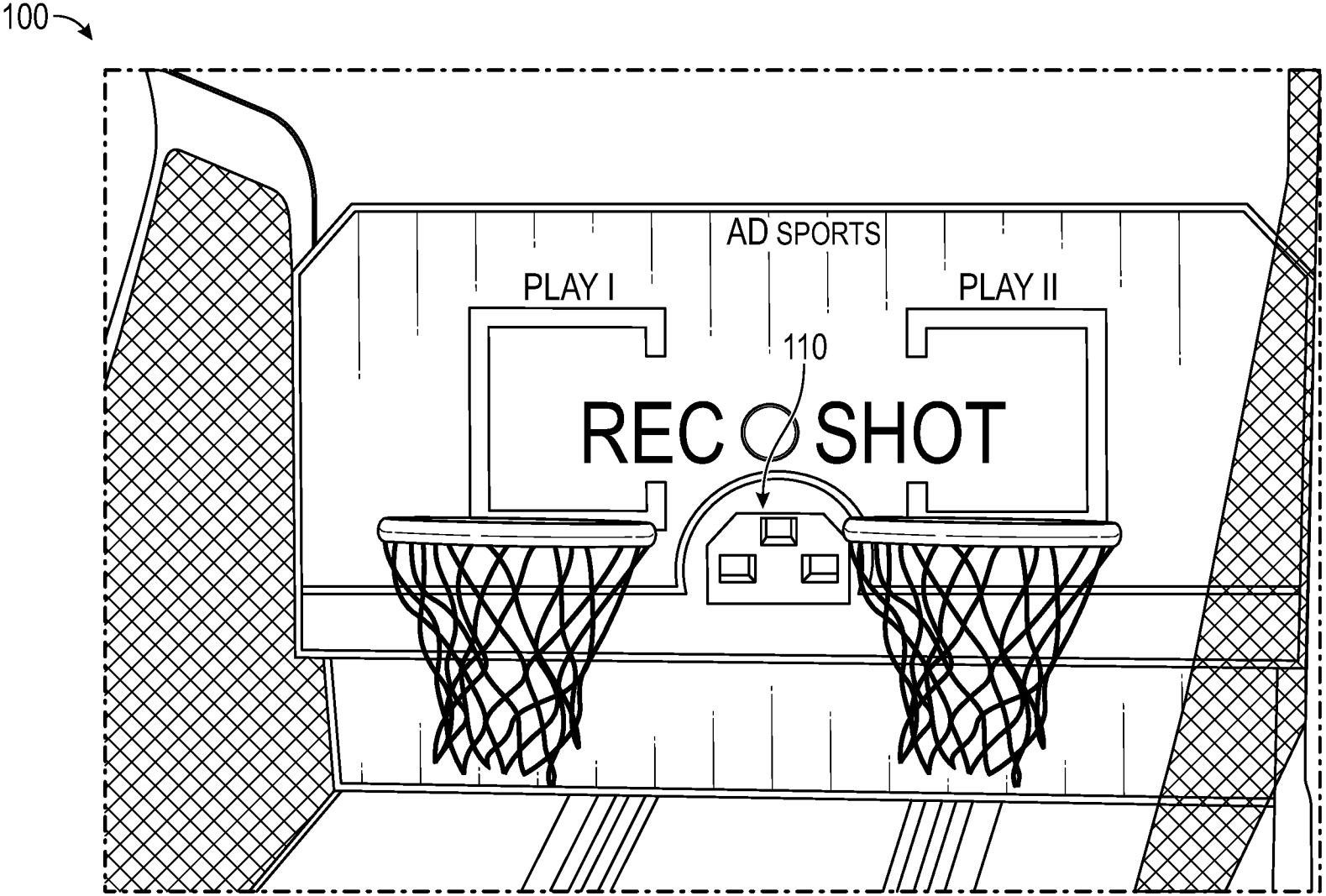
FIG. 2 shows a diagram of an example table game apparatus, according to an example embodiment of the present disclosure.

Likewise, FIG. 2 shows a diagram of the example table game apparatus 100, according to an example embodiment of the present disclosure. As depicted in FIG. 2 the backboard panel of the table game apparatus 100 includes the electronic scoring system 110. In an example embodiment, the electronic scoring system 110 is located between a plurality of basketball rims disposed on the backboard of the table game apparatus 100.

Electronic Scoring System

Figure 3:
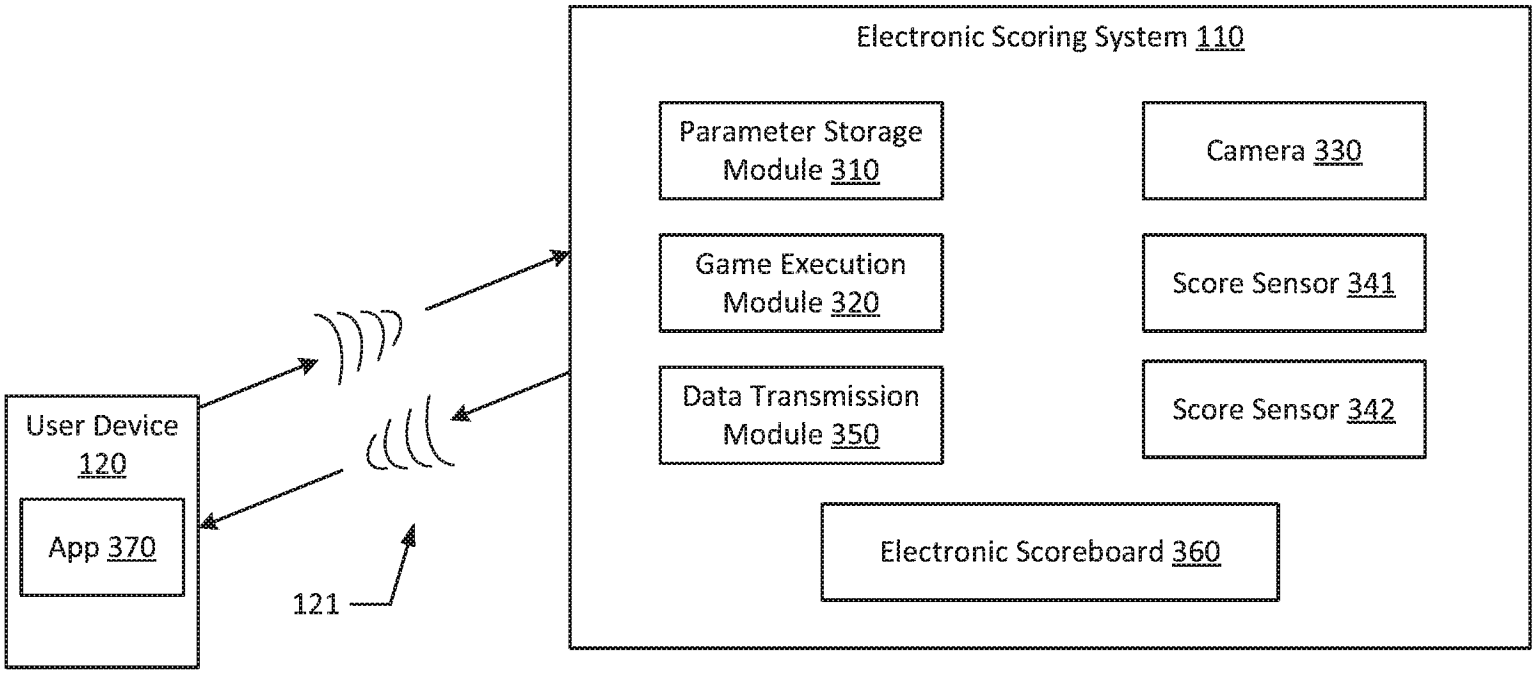
FIG. 3 shows a system diagram of an example electronic scoring system, according to an example embodiment of the present disclosure.

FIG. 3 shows a system diagram of an example electronic scoring system 110, according to an example embodiment of the present disclosure. The electronic scoring system 110 includes a data transmission module 350. The data transmission module 350 is in communication with the user device 120. More particularly, the data transmission module 350 is in communication with the user device 120 via communication link 121. In an example embodiment, the user device 120 is a cell phone. In other example embodiments, the user device 120 may be any electronic device such as a tablet, personal computer, MP3 player, etc. The user device 120 additionally includes a third-party application 370 (e.g., a cell phone software application). In an example embodiment, the communication link 121 is a WiFi connection between the electronic scoring system 110 and the user device 120. In other example embodiments, the communication link 121 may be any wireless communication link such as radio frequency, Bluetooth®, ZigBee®, NFC, local LAN hotspot, server hotspot, Internet, etc.

The electronic scoring system 110 further includes a game execution module 320. The game execution module 320 is in communication with the data transmission module 350. In an example embodiment, the game execution module 320 includes a processor. As used herein, a processor refers to a device capable of executing instructions encoding arithmetic, logical, and/or I/O operations. In one illustrative example, a processor may follow Von Neumann architectural model and may include an arithmetic logic unit (ALU), a control unit, and a plurality of registers. In an example embodiment, a processor may be a single core processor which is typically capable of executing one instruction at a time (or process a single pipeline of instructions), or a multi-core processor which may simultaneously execute multiple instructions. In another example embodiment, a processor may be implemented as a single integrated circuit, two or more integrated circuits, or may be a component of a multi-chip module (e.g., in which individual microprocessor dies are included in a single integrated circuit package and hence share a single socket). A processor may also be referred to as a central processing unit (CPU).

The electronic scoring system 110 also includes a parameter storage module 310. The parameter storage module 310 is in communication with the game execution module 320. In an example embodiment, the parameter storage module 310 includes a memory. As discussed herein, a memory refers to a volatile or non-volatile memory device, such as RAM, ROM, EEPROM, or any other device capable of storing data.

The electronic scoring system 110 further includes a camera 330. The camera 330 is in communication with the game execution module 320. In an example embodiment, the camera 330 is configured to capture video. In a different example embodiment, the camera 330 is configured to capture still images and/or video and still images.

The electronic scoring system 110 further includes a plurality of score sensors 341/342. The plurality of score sensors 341/342 are in communication with the game execution module 320. In an example embodiment, the plurality of score sensors 341/342 are electro-mechanical pressure sensors (e.g., paddle sensors). For example, as a basketball passes through a basketball rim, it comes in contact with an electro-mechanical pressure sensor. The sensor, in response, generates an electrical signal that is communicated to the game execution module 320. This electrical signal, for example, signifies a made basket. In other example embodiments, the plurality of score sensors 341/342 are any of piezoelectric sensors, stress-strain sensors, other mechanical sensors, optical sensors, ultrasonic sensors, etc.

The electronic scoring system 110 further includes an electronic scoreboard 360. The electronic scoreboard 360 is in communication with the game execution module 320. The electronic scoreboard 360 is configured to visually display information to the user. For example, the electronic scoreboard 360 may display a time limit and/or a live-score to the user. Likewise, for example, the electronic scoreboard 360 may display other types of information (e.g., game type, player name selection, player avatar selection, etc.) to the user. The electronic scoreboard 360 is beneficial, to the user, during in-game play because of its positioning on the electronic scoring system 110. Through the electronic scoreboard 360, the user is able to actively see time limit and/or live-score, while playing (e.g., while shooting baskets).

In an example embodiment, electronic scoring system 110 may further include at least one speaker, in communication with the game execution module 320. The at least one speaker may emit sound (e.g., soundtrack music, sound effects, etc.) with regards to particular aspects of games (e.g., specific songs for specific game types, specific sound effects for specific game actions such as made/missed baskets, specific sound indications for specific timing aspects of the game, etc.).

Game Execution

Figure 4:
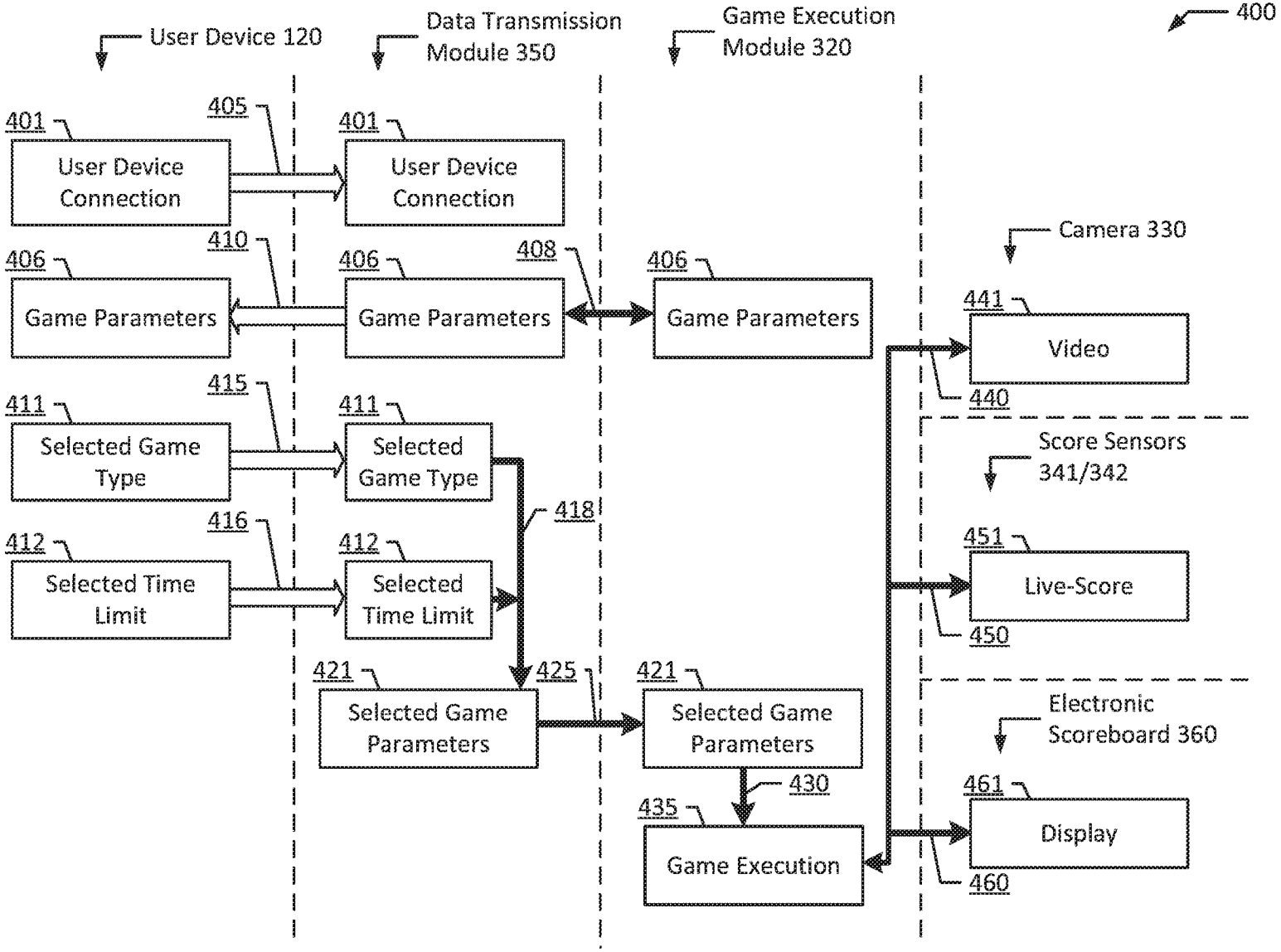
FIG. 4 shows a flow diagram of an example process of an electronic scoring system communicating with a user device and executing a game, according to an example embodiment of the present disclosure.

FIG. 4 shows a flow diagram of an example process 400 of an electronic scoring system 110 (as described above with reference to FIG. 3) communicating with the user device 120 and executing a game 435, according to an example embodiment of the present disclosure. More particularly, the user device 120 may establish a user device connection 401 (e.g., communication link 121) with the data transmission module 350 of the electronic scoring system 110 (action 405). In an example embodiment, the user device connection 401 is a WiFi connection. Specifics regarding establishing the user device connection 401 (action 405) as a WiFi connection are discussed, in greater detail, with reference to FIG. 6.

The game execution module 320 of the electronic scoring system 110 provides game parameters 406 to the data transmission module 350 (action 408). In an example embodiment, game parameters 406 include game type and time limit. In other example embodiments, game parameters 406 may include additional parameters such as, for example, display configuration selection, teaching/instruction mode selection, slow mode selection, replay mode selection, single-player mode selection, multi-player mode selection, player name selection, player avatar selection, etc. (as described in greater detail below). The quantity and types of game parameters 406 may be dictated by the third-party application 370 running on the user device 120. In an example embodiment, additional parameters are dictated by the third-party application 370 communicating with an external server (e.g., the Internet). In an example embodiment, the game execution module 320 communicates with the parameter storage module 310 to retrieve the game parameters 406 stored on the electronic scoring system 110. The data transmission module 350 then sends the game parameters 406 to the user device 120 (action 410).

In an example embodiment, the user device 120 displays the game parameters 406 to the user. For example, the third-party application 370 running on the user device 120 displays the game parameters 406 on a screen or display of the user device 120. In an example embodiment, the third-party application 370 presents, to the user, information on the user device 120 that is received from the data transmission module 350. For example, the data transmission module 350 may send game parameters 406 (e.g., customizable options associated with electronic scoring system 110 and table game apparatus 100) to the user device 120. The third-party application 370 processes this receipt of information from the data transmission module 350, and subsequently provides the information (e.g., graphical presentation of the information) to the user.

The user device 120 sends a selected game type 411 to the data transmission module 350 (action 415). More particularly, through the third-party application 370, the user is provided the ability to select, for example, the selected game type 411 from a number of various game types, which are presented to the user by third-party application 370. In example embodiments, the selected game type 411 may be any one of head-to-head shootout, first to a given number of points, teaching/instruction mode, etc. In an example embodiment, the selected game type 411 is selected from one of a plurality of game types (e.g., game parameters 406) provided by the electronic scoring system 110. In a different example embodiment, the selected game type 411 is selected from one of a plurality of external game types provided by the user device 120, connected to an external data network (e.g., the Internet). In this way, external sources of information (e.g., the product manufacturer) can continuously provide new game types to be accessed by user device 120 via third-party application 370. The third-party application 370 provides a number of various game types, and allows the user to make a selection (e.g., selected game type 411) on the user device 120. The third-party application 370 receives the user's selection, processes this information, and provides the user's selection to the electronic scoring system 110. By providing the selected game type 411 to the electronic scoring system 110, the third-party application 370 running on user device 120 facilitates the decision making process for the user. The third-party application 370 provides the resulting user selection, such that the selection (e.g., selected game type 411) is sent from the user device 120 to the data transmission module 350 (action 415). The selected game type 411 becomes one of the selected game parameters 421 that is subsequently provided to the game execution module 320 (action 425) as disclosed herein.

Likewise, the user device 120 sends a selected time limit 412 to the data transmission module 350 (action 416). For example, through the third-party application 370, the user is able to select, for example, the selected time limit 412 from a number of various time limits (e.g., 30 second time limit, 60 second time limit, 120 second time limit, unlimited time limit, etc.) presented to the user by third-party application 370. In an example embodiment, the selected time limit 412 is selected from one of the plurality of time limits provided by the electronic scoring system 110. Alternatively, third-party application 370 may present the user with the ability to enter a customized time limit (e.g., 37 second time limit) on the user device 120. The third-party application 370 receives the user's selection, processes this information, and provides the user's selection to the electronic scoring system 110. By providing the selected time limit 412 to the electronic scoring system 110, the third-party application 370 running on user device 120 facilitates the decision making process for the user. The third-party application 370 provides the resulting user selection, such that the selection (e.g., selected time limit 412) is sent from the user device 120 to the data transmission module 350 (action 415). The selected time limit 412 becomes one of the selected game parameters 421 that is subsequently provided to the game execution module 320 (action 425) as disclosed herein.

In an example embodiment, the user device 120 may receive, process, and send a plurality of additional selections regarding the plurality of additional parameters selected by the user (e.g., display configurations, teaching/instruction mode, slow mode, replay mode, single-player mode, multi-player mode, player name selection, player avatar selection) to the data transmission module 350. Each of these additional parameters may be provided to the user through the third-party application 370 and selected by the user on the user device 120. Likewise, each of these additional parameters, once selected, may be provided to the electronic scoring system 110, such that the selection is sent from the user device 120 to the data transmission module 350 (e.g., action 415). Each of these additional parameters affects the game execution module 320 in particular ways. Each of these additional parameters further affects how the game execution module 320 interacts with additional modules (e.g., parameter storage module 310) and related components (e.g., camera 330, overlay video 515, etc.) of the electronic scoring system 110, as described below.

For example, the user device 120 may send the additional parameter of display configurations to the data transmission module 350. In an example embodiment, display configurations is an additional parameter that provides the user with capabilities to customize information provided by the electronic scoring system 110. Responsive to receiving the additional parameter of display configurations, the data transmission module 350 communicates the selection to the game execution module 320. With display configurations, the game execution module 320 may, for example, modify the configuration for display 461 of electronic scoreboard 360, such that the physical display of electronic scoreboard 360 is customized to have a particular configuration (e.g., display score only, display player's name only, display score and player's name, etc.). Likewise, the game execution module 320 may, for example, modify the overlay video 515 (described in greater detail with reference to FIG. 5) that it generates, such that the overlay video 515 includes a particular configuration (e.g., image layouts, graphics, filters, etc.)

Likewise, for example, the user device 120 may send the additional parameter of teaching/instruction mode to the data transmission module 350. In an example embodiment, teaching/instruction mode is an additional parameter that provides the user with instructive information generated by the electronic scoring system 110. Responsive to receiving the additional parameter of teaching/instruction mode, the data transmission module 350 communicates the selection to the game execution module 320. With teaching/instruction mode, the game execution module 320 may, for example, analyze video 441 (e.g., video footage of the user shooting basketball) retrieved from camera 330. More particularly, the game execution module 320 may analyze the user's shot form (e.g., position of hands and/or arms relative to body, head, and/or ball) and generate instructive information. The game execution module 320 may send the instructive information to the data transmission module 350, such that the data transmission module subsequently provides the information to the user device 120. Likewise, in a related example, the game execution module 320 may interpret the sensitivity of score sensors 341/342 to further analyze the user's shot profile. For example, score sensors 341/342 may detect the magnitude at which the ball strikes the sensor (e.g., via a piezoelectric force sensor implemented by the score sensors 341/342). Magnitude information may be coupled with the ball's trajectory (e.g., as observed and recorded by camera 330). Using magnitude information (provided by score sensors 341/342) and trajectory (provided by camera 330), the game execution module 320 may calculate additional analytics including ball flight path, arc, trajectory angle, velocity, etc. These analytics may be used, by the game execution module 320, to supplement previously generated instructive information (e.g., diagramming proper shot form, dynamic analysis of the user's shot, recommendations regarding form improvement, critique, tips, etc.

Likewise, for example, the user device 120 may send the additional parameter of slow mode to the data transmission module 350. In an example embodiment, slow mode is an additional parameter that provides the user with capability to customize the overlay video 515 generated by the game execution module 320. Responsive to receiving the additional parameter of slow mode, the data transmission module 350 communicates the selection to the game execution module 320. With slow mode, the game execution module 320 may, for example, modify the overlay video 515 and/or camera 330, such that overlay video 515 has a reduced video recording rate.

Likewise, for example, the user device 120 may send the additional parameter of replay mode to the data transmission module 350. In an example embodiment, replay mode is an additional parameter that provides the user with the ability to have a new dynamic game generated by the electronic scoring system 110. Responsive to receiving the additional parameter of replay mode, the data transmission module 350 communicates the selection to the game execution module 320. With replay mode, the game execution module 320 may, for example, record a game played by the user (e.g., shooting baskets for a predefined time). More particularly, the game execution module 320 may record information about the game including visual information (e.g., video 441), score information (e.g., live-score 451), timing information (e.g., game timer managed by game execution module 320), etc. Consequently, the game execution module 320 will generate a new game utilizing recorded information from the previous game. For example, the user may effectively replay himself, competing against his previous performance metrics.

Likewise, for example, the user device 120 may send the additional parameter of single-player mode to the data transmission module 350. In an example embodiment, single-player mode is an additional parameter that provides the user with the ability to play a game by himself. Responsive to receiving the additional parameter of single-player mode, the data transmission module 350 communicates the selection to the game execution module 320. With single-player mode, the game execution module 320 may, for example, disengage particular aspects (e.g., score sensor 342) of the electronic scoring system 110. For example, the game execution module 320 may physically associate score sensor 342 with an un-used basketball rim. Disengagement of particular aspects may ensure that inadvertent baskets made on an inappropriate score sensor (e.g., score sensor 342) do not affect the live score 451 of the configured game. Alternatively, with single-player mode, the game execution module 320 may, for example, enable both score sensors 341/342. Enablement of both score sensors 341/342 could be implemented in configurations where the user is required to make a shot on one of the baskets (e.g., the left basket) and then make the next shot on the other basket (e.g., the right basket).

Likewise, for example, the user device 120 may send the additional parameter of multi-player mode to the data transmission module 350. In an example embodiment, multi-player mode is an additional parameter that provides the user with the ability to play a game with at least one other player (e.g., two or more total players). Responsive to receiving the additional parameter of multi-player mode, the data transmission module 350 communicates the selection to the game execution module 320. With multi-player mode, the game execution module 320 may, for example, engage particular aspects (e.g., score sensors 341/342) of the electronic scoring system 110. For example, the game execution module 320 may physically associate each of the score sensors 341/342 with a particular basketball rim and with a particular player (e.g., head-to-head play). Likewise, for example, the game execution module 320 may physically associate the electronic scoreboard 360 with a particular basketball rim and a particular player's score (e.g., a first player's score as measured by score sensor 341). Game execution module 320 may further track and record (e.g., storing on parameter storage module 310) each player's score as detected by score sensors 341/342. The game execution module 320 may further determine a high score and a low score (e.g., determining winner and loser). Multi-player mode may have a number of additional distinctive varieties, as dictated by the electronic scoring system 110 and/or the third-party application 370, which may cause the game execution module 320 to perform alternate game executions. For example, in one configuration (e.g., head-to-head), the game execution module 320 may configure a game (e.g., score sensors 341/342 and game timer) for simultaneous play (e.g., two players competing, such that each player attempts to make a maximum number of shots simultaneously during a given time period). In an alternate configuration (e.g., back-to-back), for example, the game execution module 320 may configure a game (e.g., score sensors 341/342 and game timer) for alternate play (e.g., one player shooting baskets for a given time period, followed by a second player shooting baskets for the given time period).

Likewise, for example, the user device 120 may send the additional parameter of player name selection to the data transmission module 350. In an example embodiment, player name selection is an additional parameter that provides the user with the ability to customize player information provided to the electronic scoring system 110. Responsive to receiving the additional parameter of player name selection, the data transmission module 350 communicates the selection to the game execution module 320. With player name selection, the game execution module 320 may, for example, modify display 461 of electronic scoreboard 360, such that the physical display of electronic scoreboard 360 is customized to include a user-selected name (e.g., "Big Time Bailer"). Likewise, the game execution module 320 may, for example, modify the overlay video 515 that it generates, such that the overlay video 515 includes the user-selected name.

Likewise, for example, the user device 120 may send the additional parameter of player avatar selection to the data transmission module 350. In an example embodiment, player avatar selection is an additional parameter that provides the user with the ability to customize player information provided to the electronic scoring system 110. Responsive to receiving the additional parameter of player avatar selection, the data transmission module 320 communicates the selection to the game execution module 320. With player avatar selection, the game execution module 320 may, for example, modify display 461 of electronic scoreboard 360, such that the physical display of electronic scoreboard 360 is customized to include a user-selected avatar (e.g., a picture, thumbnail, drawing, logo, GIF video, etc.). Likewise, the game execution module 320 may, for example, modify the overlay video 515 that it generates, such that the overlay video 515 includes the user-selected avatar.

To summarize, each of the additional parameters as described above supplement the game parameters 406 (e.g., selected game type 411 and selected time limit 412). The additional parameters: display configurations, teaching/instruction mode, slow mode, replay mode, single-player mode, multi-player mode, player name selection, and player avatar selection result in physical changes to the electronic scoring system 110 and the game execution module 320. By comparison, known table game systems do not have this type of user interaction. Typically, users are unable to physically modify aspects of table games for customization. Thus, the parameters discussed above allow the user to interact with the electronic scoring system in ways previously not contemplated by typical table games.

Continuing on with example process 400, the selected game type 411 and the selected time limit 412 are aggregated, by the data transmission module 350 (action 418) as selected game parameters 421. In an example embodiment, the plurality of additional selections may, likewise, be aggregated as selected game parameters 421. The data transmission module 350 provides the selected game parameters 421 to the game execution module 350 (action 425).

The game execution module 320 then incorporates the selected game parameters 421 (action 430) for game execution 435. Through game execution 435, the game execution module 320 creates a game (e.g., a basketball game) to be played by the user (e.g., on table game apparatus 100). By incorporating the selected game parameters 421, for example, the game execution module 320 defines the game (e.g., the basketball game) to be played by the selected game type 411 (e.g. head-to-head shootout). Likewise, for example, the game execution module 320 defines the game to be played by the selected time limit 412, such that the game is played for a duration defined by the selected time limit 412. The duration, as defined by the selected time limit 412, is monitored by a game timer that is managed and controlled by game execution module 320.

Game execution 435 includes communication with camera 330 (action 440) to retrieve a video 441. Game execution 435 includes communication with score sensors 341/342 (action 450) to retrieve a live-score 451. Game execution 435 includes communication with electronic scoreboard 360 (action 460) to update a display 461. Each of these individual communications (e.g., actions 440, 450, 460) are occurring dynamically during the duration of game execution 435 (e.g. during selected time limit 412). For example, by retrieving the live-score 451 from score sensors 341/342, the game execution module 320 dynamically updates the display 461 of the electronic scoreboard 360. In this way, the electronic scoreboard 360 visually indicates the live-score 451 to the user. Likewise, it is through game execution 435 that the game execution module generates overlay video 515.

Generating Overlay Video

Figure 5:
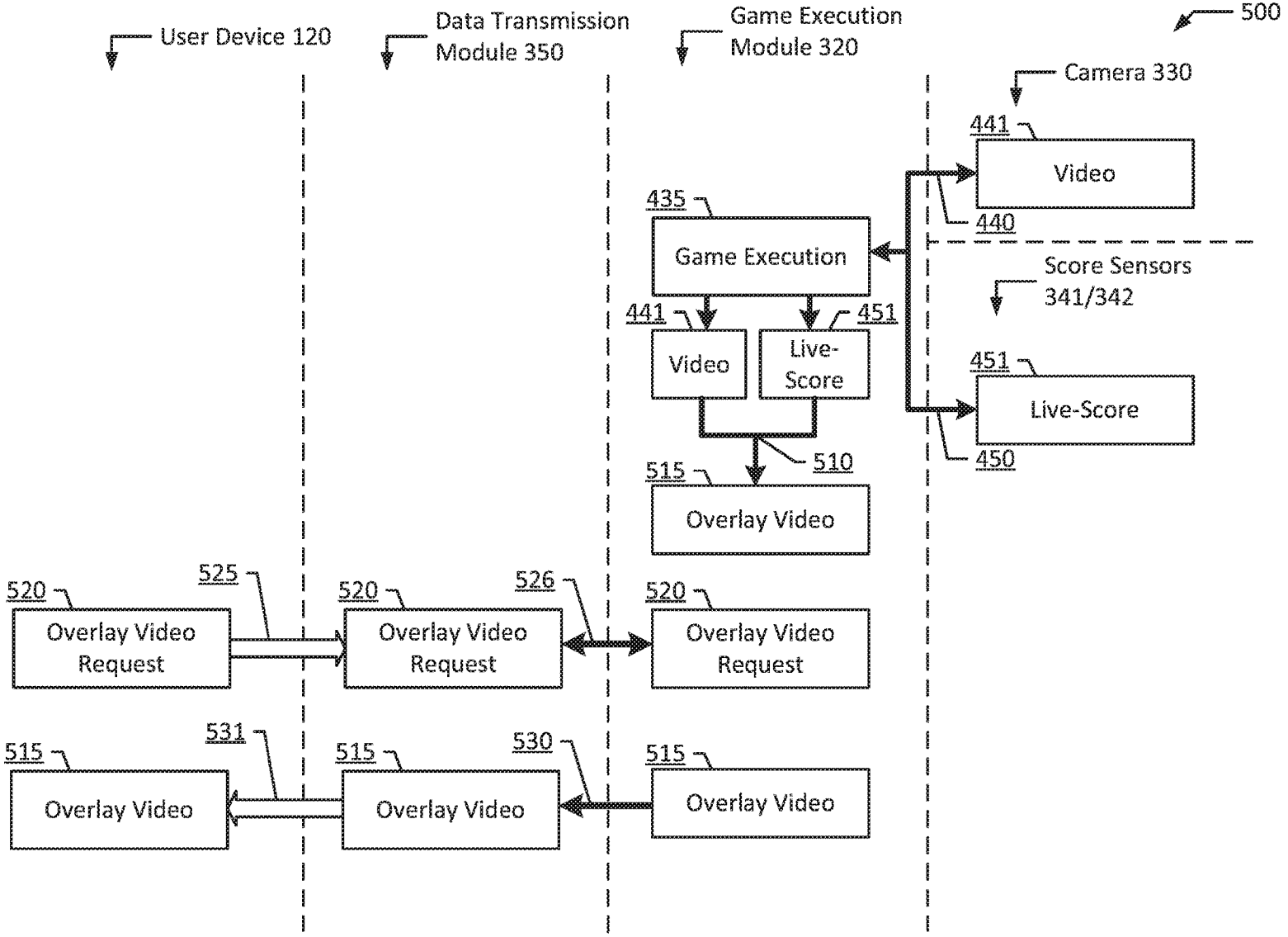
FIG. 5 shows a flow diagram of an example process of an electronic scoring system communicating with a user device and generating an overlay video, according to an example embodiment of the present disclosure.

FIG. 5 shows a flow diagram of an example process 500 of an electronic scoring system 110 communicating with the user device 120 and generating an overlay video 515, according to an example embodiment of the present disclosure. More particularly, the game execution module 320 performs game execution 435 (as described in detail above with reference to FIG. 4). As noted above, game execution 435 includes communication with camera 330 (action 440) to retrieve the video 441. Likewise, game execution 435 includes communication with score sensors 341/342 (action 450) to retrieve the live-score 451.

In an example embodiment, the video 441 recorded by the camera 330 is a video of the user playing the game. For example, the video 441 may be a recording of the user playing a basketball game on table game apparatus 100. Likewise, in an example embodiment the live-score 451 generated by the score sensors 341/342 is the live-score associated with the user playing the game. For example, the live score 451 may be a quantity of baskets made by the user, while playing the basketball game on table game apparatus 100. In an example embodiment, the game execution module 320 communicates with the parameter storage module 310, such that each of the video 441 and the live-score 451 are stored on the parameter storage module 310 once retrieved by game execution module 320.

The game execution module 320 generates an overlay video 515 (action 510). In an example embodiment, generating the overlay video 515 includes combining the video 441 and the live-score 451. More particularly, the overlay video 515 is a new video that incorporates both the video 441 and a graphical representation of the live-score 451. For example, the game execution module 320 generates a new video file (e.g., GIF video file) that includes the original video file (e.g., video 441) with an image (e.g., a JPEG image) of the live-score 451 interposed on top of the original video file, such that the new video file (e.g., overlay video 515) effectively incorporates two data streams. Additionally, the image (e.g., the JPEG image) of the live score 451 is dynamically updated by the game execution module 320, in response to data received from score sensors 341/342 (e.g., as the live score 451 increases).

Incorporation of two data streams (e.g., video 441 and live-score 451) into one new data stream (e.g., overlay video 515) is performed via the game execution module 320 (action 510). For example, the game execution module 320 may take a first digital video (e.g., video 441) and a second digital video or image (e.g., a graphical representation of live-score 451), and generate a third digital video (e.g., overlay video 515) that includes both the first digital video and the second digital video or image. The game execution module 320 may also match time stamps of each of the first digital video and the second digital video, such that the newly created third digital video includes a contemporaneous presentation of both the first digital video and the second digital video or image. Alternatively, the game execution module 320 may convert the first digital video (e.g., video 441) into an alternate data file (e.g., a digital file). This alternate data file may be stored on the parameter storage module 310. The game execution module 320 may then add, to this alternate data file, overlay information (e.g., header data). For example, overlay information may include at least a graphical representation of live score 451. Finally, the game execution module 320 may convert the alternate data file back to a video file (e.g., overlay video 515). In an example embodiment, incorporation of data streams by the game execution module 320 is dictated by software (e.g., video editing software) executing on the game execution module 320. In various examples, software may be native to the electronic scoring system 110 (e.g., pre-loaded onto game execution module 320) or may be external to the electronic scoring system 110 (e.g., downloaded to the game execution module 320 via the Internet).

In an example embodiment, the overlay video 515 includes the video 441 of the user playing a basketball game on table game apparatus 100, and also includes the live-score 451 of baskets made by the user, while playing the basketball game on table game apparatus 100, as detected and dynamically updated by the game execution module 320 communicating with score sensors 341/342. In this example, the overlay video 515 is continuously updated with the live-score 451 by the game execution module 320, such that the overlay video 515 contemporaneously shows both the video 441 of the user making a basket and the live-score 451 increasing in response to the user making the basket. In other example embodiments, the overlay video 515 may include additional features. For example, the overlay video 515 may include graphical information regarding display configurations, teaching/instruction mode, slow mode, replay mode, single-player mode, multi-player mode, player name selection, player avatar selection, etc. As previously noted, the quantity and types of game parameters 406 provided to the game execution module 320 and included in overlay video 515 may be dictated by the third-party application 370 running on the user device 120.

In an example embodiment, each of the video 441 and the live-score 451 may be retrieved from the parameter storage module 310, by the game execution module 320, prior to generation (action 510) of the overlay video 515. Likewise, in example embodiment, the game execution module 320 communicates with the parameter storage module 310, such the overlay video 515, once generated, is stored on the parameter storage module 310.

In an alternate example embodiment, the overlay video 515 is generated by the user device 120 via the third-party application 370. In this alternate example embodiment, each aspect of the overlay video 515 (e.g., video 441 and live-score 451) is individually provided to the user device 120 via the data transmission module 350. Upon receipt, the third-party application 370 may generate the overlay video 515. For example, the third-party application 370 may generate a new video file (e.g., GIF video file) that includes the original video file (e.g., video 441) with an image (e.g., a JPEG image) of the live-score 451 interposed on top of the original video file, such that the new video file (e.g., overlay video 515) incorporates two data streams. Incorporation of the two data streams may include, for example, time stamp matching between video 441 and live-score 451, such that the data from each stream contemporaneously matches data from the other stream.

In an alternate related example embodiment, each of the individual data streams (e.g., video 441 and live-score 451) are individually received, and individually displayed, by user device 120 via third-party application 370. For example, instead of displaying overlay video 515, the third-party application 370 may display two separate streams simultaneously (e.g., side-by-side presentation of information, top-bottom presentation of information, etc.). Alternatively, for example, the third-party application 370 may display only one stream (e.g., live-score 451) and not display the other stream (e.g., video 441). Display configurations regarding presentation of information on third-party application 370 may be customized and selected by the user, as previously described herein. Likewise, in another alternate related example embodiment, only some of the individual data streams (e.g., live-score 451) are initially received and displayed by user device 120 via third-party application 370. For example, live-score 451 may be contemporaneously streamed to user device 120 during gameplay. By comparison, other individual data streams (e.g., video 441) may remain on the electronic scoring system 110 (e.g., stored on the parameter storage module 310) until a later time. For example, video 441 may remain on the electronic scoring system 110 until the game is finished (and video recording has ceased). Alternatively, data streams may remain on the electronic scoring system 110 (e.g., stored on the parameter storage module 310) until requested by a user, as disclosed below.

The user device 120 sends an overlay video request 520 to the data transmission module 350 (action 525). In an example embodiment, the overlay video request 520 is sent, by the user, through the third-party application 370 running on the user device 120. For example, the user makes a request on the third-party application 370, such that the user device 120 sends the overlay video request 520 to the data transmission module 350. In an example embodiment, the request on the third-party application 370, as provided to the user, is one of stream video and/or download video. The data transmission module 350 provides the overlay video request 520 to the game execution module 320 (action 526). In response to receiving the overlay video request 520, the game execution module 320 provides the overlay video 515 to the data transmission module 350 (action 530). In an example embodiment, the game execution module 320 communicates with the parameter storage module 310 to retrieve the overlay video 515. The data transmission module 350 sends the overlay video 515 to the user device 120 (action 531). In a different example embodiment, the overlay video request 520 is not required. For example, responsive to generation of the overlay video 515, the game execution module 320 provides the overlay video 515 to the data transmission module 350 (action 530), such that the overlay video 515 is automatically sent to user device 120 (action 531). Automatically sending the overlay video 515 can further trigger additional automatic actions such as, for example, automatically initiating the third-party application 370 on the user device 120 (e.g., the third-party application 370 is automatically opened).

In an alternate example embodiment, sending the overlay video request 520 to the data transmission module 350 (action 525) may trigger other interactions between the data transmission module 350 and the game execution module 320. For example, the overlay video request 520 may result in the game execution module 320 providing the video 441 (e.g., the originally recorded video) to the data transmission module 350 (action 530) to be subsequently sent to the user device 120. Alternatively, for example, the overlay video request 520 may result in the game execution module 320 providing the live-score 451 (e.g., the score history, final score, etc.) to the data transmission module 350 (action 530) to be subsequently sent to the user device 120. Alternatively, for example, the overlay video request 520 may result in sending other types of information (e.g., game type, time limit, display configuration selection, teaching/instruction mode selection, slow mode selection, replay mode selection, single-player mode selection, multi-player mode selection, player name, selection, player avatar selection, other related data, etc.) to the user device 120.

In an example embodiment, the user device 120 displays the overlay video 515 to the user. For example, the third-party application 370 running on the user device 120 displays the overlay video 515 to the user. Specific diagrams of example configurations of the overlay video 515 (and other display configurations) are discussed in greater detail below, with reference to FIGS. 7A-F.

In an example embodiment, in response to receiving the overlay video request 520, the data transmission module 350 sends the overlay video 515 to the user device 120 (action 531), such that the user device 120 is provided access to display the overlay video 515. For example, the user may access the data transmission module 350 through the third-party application 370 to actively stream and display the overlay video 515 on the user device 120. In a different example embodiment, in response to receiving the overlay video request 520, the data transmission module 350 sends the overlay video 515 to the user device 120 (action 531), such that the user device 120 is provided access, via the third-party application 370, to retrieve the overlay video 515. For example, the user may access the data transmission module 350 (e.g., via the third-party application 370) to download the overlay video 515 onto the user device 120, such that the overlay video 515 is physically stored on the user device 120. In other example embodiments, the overlay video 515 may be stored in alternate locations (e.g., an external server) which may be accessible by both the user device 120 and/or the data transmission module 350.

Method of Communicating With a User Device

Figure 6:
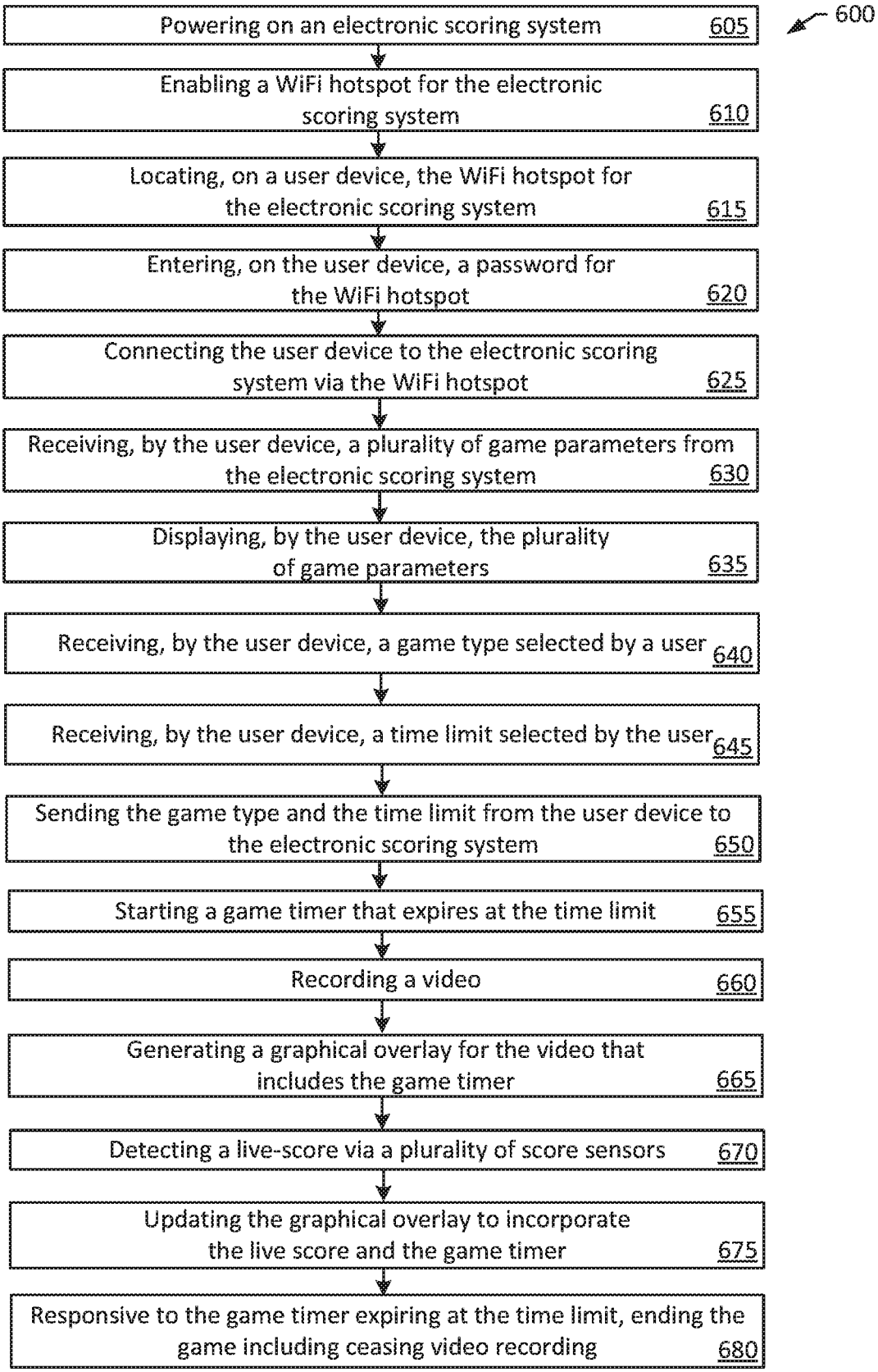
FIG. 6 shows a flow chart of an example method of an electronic scoring system communicating with a user device.

In an example embodiment, with reference to FIG. 6, a method 600 of communication between an electronic scoring system 110 and the user device 120 includes powering on the electronic scoring system 110 (block 605). In an example embodiment, the electronic scoring system 110 is powered by an external power source. In a different example embodiment, the electronic scoring system 110 is powered by an internal power source (e.g., Li-Ion battery). In an example embodiment, the user device 120 is a cell phone. In other example embodiments, the user device 120 may be any electronic device such as a tablet, personal computer, MP3 player, etc.

The method 600 includes enabling a WiFi hotspot for the electronic scoring system 110 (block 610). In alternate example embodiments, the hotspot may be any one of radio frequency, Bluetooth®, ZigBee®, NFC, local LAN hotspot, server hotspot, Internet, etc. The method 600 includes locating, on the user device 120, the WiFi hotspot for the electronic scoring system 110 (block 615). The method 600 includes entering, on the user device 120, a password for the WiFi hotspot (block 620). In an example embodiment, the password is a WiFi Protected Access 2-Pre-shared Key. The method 600 includes connecting the user device 120 to the electronic scoring system 110 via the WiFi hotspot (block 625). In an example embodiment, the user device 120 is connected to the data transmission module 350 of the electronic scoring system 110 via communication link 121.

The method 600 includes receiving, by the user device 120, a plurality of game parameters 406 from the electronic scoring system 110 (block 630). In an example embodiment, the plurality of game parameters 406 are provided, to the user device 120, by the data transmission module 350.

The method 600 includes displaying, by the user device 120, the plurality of game parameters 406 (block 635). In an example embodiment, the plurality of game parameters 406 are displayed, by the user device 120, through a third-party application 370 (e.g., a smartphone app) running on the user device 120. The method 600 includes receiving, by the user device 120, a game type 411 selected by the user (block 640). For example, the user may select a particular game type 411 (e.g., head-to-head shootout) on the user device 120. The method 600 includes receiving, by the user device 120, a time limit 412 selected by the user (block 645). For example, the user may select a time limit 412 (e.g., 30 second time limit) on the user device 120. The method 600 may include receiving, by the user device 120, additional parameters (e.g., first player name, second player name, etc.).

The method 600 includes sending the game type 411 and the time limit 412 from the user device 120 to the electronic scoring system 110 (block 650). In an example embodiment, the game type 411 and the time limit 412 are sent, by the user device 120, to the data transmission module 350. In an example embodiment, additional parameters are likewise sent from the user device 120 to the electronic scoring system 110.

The method 600 includes starting a game timer, managed by game execution module 320, that expires at the time limit 412 (block 655). In an example embodiment, the game timer is managed and controlled by game execution module 320. The method 600 includes recording a video 441 (block 660). In an example embodiment, video 441 is recorded by camera 330 in communication with game execution module 320. The method 600 includes generating a graphical overlay (e.g., overlay video 515) for the video 411 that includes the game timer (block 665). In an example embodiment, the graphical overlay (e.g., overlay video 515) is generated by the game execution module 320. The method 600 includes detecting a live-score 451 via a plurality of score sensors (e.g., score sensors 341/342) in communication with game execution module 320 (block 670). The method 600 includes updating the graphical overlay (e.g., overlay video 515) to incorporate the live-score 451 and the game timer (block 675). In an example embodiment, the graphical overlay (e.g., overlay video 515) is updated by the game execution module 320. The method 600 includes, responsive to the game timer expiring at the time limit 412, ending the game including ceasing the video recording (block 680).

User Device Configuration

Figure 7C:
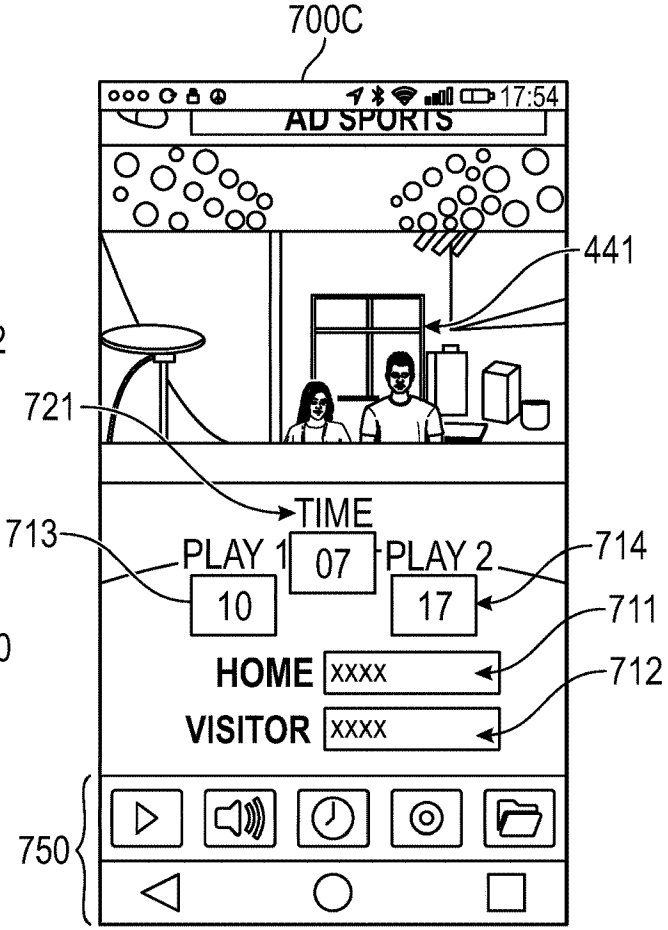
FIGS. 7A-F show diagrams of example configurations of user devices communicating with an electronic scoring system.
Figure 7B:
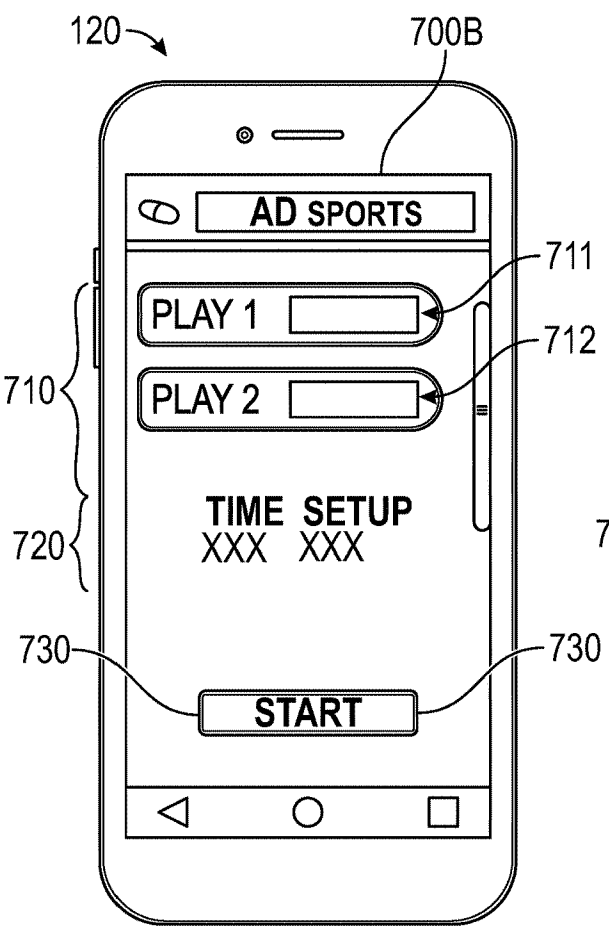
Figure 7A:
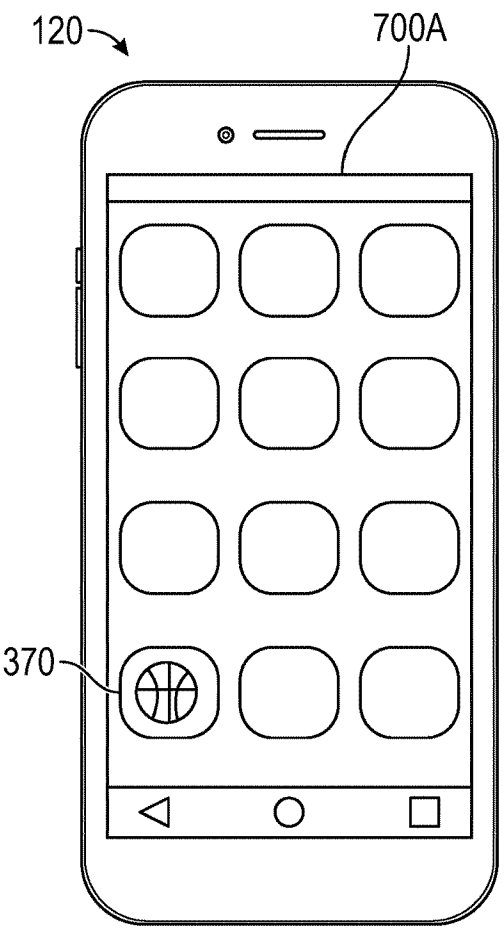

FIGS. 7A-F show diagrams of example configurations of user devices communicating with an electronic scoring system. For example, as illustrated by FIG. 7A, the user device 120 displays configuration 700A. Configuration 700A includes a selectable icon for third-party application 370. For example, configuration 700A may be a typical configuration of a home screen for user device 120 (e.g., cell phone, tablet, personal computer, MP3 player, etc.).

Upon selection of the third-party application 370, the user may be presented with the ability to input parameters, such that the user device 120 subsequently provides the parameters to the electronic scoring system 110. In this way, through the third-party application 370, the user is afforded the opportunity to customize the individual experience of the table game apparatus 100 and associated electronic scoring system 120. For example, the third-party application 370 running on the user device 120 may display the game parameters 406 to the user. These game parameters 406 (e.g., customizable options associated with electronic scoring system 110 and table game apparatus 100) are selectable, by the user, via the third-party application 370. Upon selection, the third-party application 370, through the user device 120, sends the selected game type 411 to the data transmission module 350. For example, the user selects the selected game type 411 from a number of various game types presented to the user by third-party application 370. Likewise, the user is able to select, for example, the selected time limit 412 from a number of various time limits (e.g., 30 second time limit, 60 second time limit, 120 second time limit, etc.) presented to the user by third-party application 370. Upon selection, the third-party application 370, through the user device 120, sends the selected time limit 412 to the data transmission module 350. In this way, the third-party application 370 may act as an intermediary between the user and the communication link 121 (e.g., the WiFi connection between user device 120 and electronic scoring system 110). The third-party application 370 receives parameters from the electronic scoring system 110, presents the parameters to the user (e.g., via user device 120), receives selections from the user (e.g., selected game type 411) and provides selections back to the electronic scoring system. These selections, including additional parameters as discussed above with reference to FIG. 4, provide the user with additional configuration and customization of the table game apparatus 100 and associated electronic scoring system 110.

Likewise, for example, as illustrated by FIG. 7B, the user device 120 displays configuration 700B. Configuration 700B includes player name selection 710 and time selection 720 (e.g., game parameters 406 as discussed above with reference to FIG. 4). For example, player name selection 710 may include a first player name 711 and a second player name 712. Player name selection 710 may include an entry field whereby the user may type each of the first player name 711 and the second player name 712 via user device 120. In an example embodiment, player name selection 710 may include additional parameters (e.g., player avatar selection, logo selection, personalized soundtrack music selection, etc.).

Likewise, for example, time selection 720 includes a choice of time limit (e.g., 30 seconds or 60 seconds). Alternatively, time selection 720 may include an entry field whereby the user may enter a numerical value for the time limit via user device 120.

Configuration 700B further includes a start button 730. Start button 730 is a user command that causes the game execution module 320 to manage and start the game timer (as described above with reference to FIG. 6) that expires at time selection 720. Prior to the game timer expiring, the game execution module 320 may record a video (e.g., video 441 via camera 330), detect score (e.g., live-score 451 via score sensors 341/342), generate a graphical overlay (e.g., overlay video 515), etc. An example of the overlay video 515 is illustrated by FIG. 7C.

For example, as illustrated by FIG. 7C, the user device 120 displays configuration 700C (e.g., overlay video 515). Configuration 700C depicts an example of multi-player mode. Configuration 700C includes video 441. In an example embodiment, video 441 is recorded by camera 330. For example, video 441 is a video of the user playing the game (e.g., basketball game on table game apparatus 100). It should be noted that video 441 is not, in any way, limited to basketball games played on table game apparatus 100. For example, table game apparatus 100 may be configured for other types of games such as any one of billiards, foosball, bumper billiards, air hockey, table tennis, target toss, pinball soccer, finger football, bowling, chess, checkers, Chinese checkers, backgammon, basketball toss, football toss, bean bag toss, etc. Thus, video 441 on configuration 700C may be a video of the user or users playing any one of these games.

Configuration 700C further includes time limit 721, which may be selected by time selection 720 (as noted above with reference to FIG. 7B). In an example embodiment, time limit 721 is an active timer, counting down from time selection 720 to zero time (e.g., no more time remaining). In a related example embodiment, the active timer is managed by the game execution module 320. Configuration 700C further includes first player score 713 and second player score 714. For example, first player score 713 may be the live-score 451 associated with first player name 711. First player score 713 may be detected by one of the plurality of score sensors (e.g., score sensor 341). Likewise, for example, second player score 714 may be the live-score 451 associated with second player name 712. Second player score 714 may be detected by one of the plurality of score sensors (e.g., score sensor 342).

Configuration 700C further includes control panel 750. Control panel 750 may provide the user with a number of additional actions with respect to electronic scoring system 110. For example, the user device 120 may actively stream and display the overlay video 515. Likewise, for example, the user device 120 may download the overlay video 515, such that the overlay video 515 is physically stored on the user device 120. Additionally, for example, the user device 120 may take actions with regards to configuration 700C, the third-party application 370, and/or user device 120 generally (e.g., change display configurations, change game modes, change player modes, change configuration setup, pause game, restart game, end game, select background music, add sound effects, change volume, etc.)

Figures 7D, 7E, 7F:
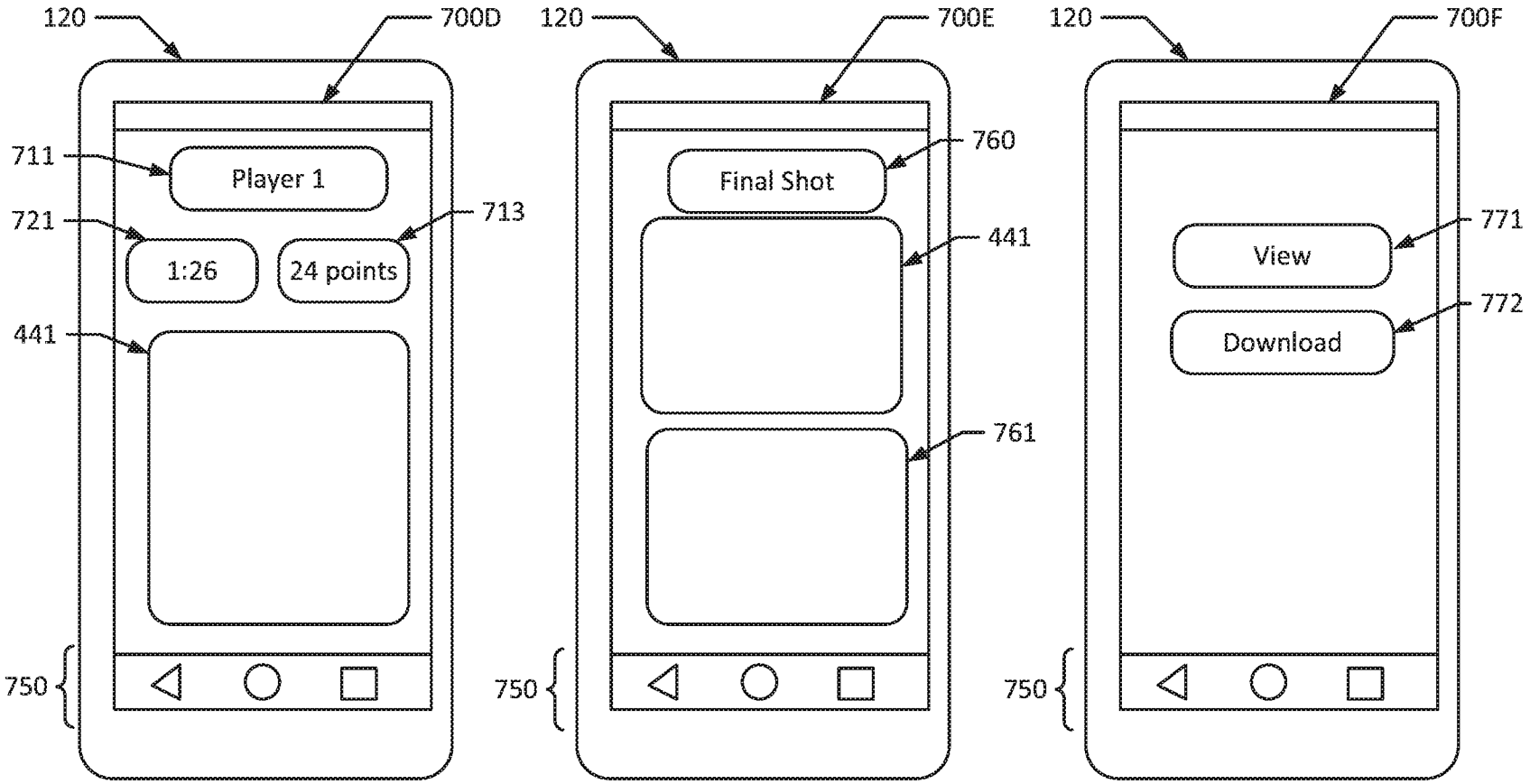

Likewise, for example, as illustrated by FIG. 7D, the user device 120 displays configuration 700D. Configuration 700D depicts an example of single-player mode. Configuration 700D includes first player name 711, first player score 713, and time limit 721. In an example embodiment, first player score 713 is the live-score 451 associated with first player name 711. In an example embodiment, time limit 721 is an active timer, counting down from time selection 720 to zero time (e.g., no more time remaining). Configuration 700D also includes video 441. In an example embodiment, in single-player mode, video 441 is cropped or edited, such that the single player is shown in the center of video 441 (as compared to video 441 illustrated by FIG. 7C, where both players are shown in the center of the video 441). Editing of video 441 (e.g., generation of overlay video 515) is performed, for example, by the game execution module 320 (as discussed above with respect to FIGS. 4 and 5). Configuration 700D further includes control panel 750.

Likewise, for example, as illustrated by FIG. 7E, the user device 120 displays configuration 700E. Configuration 700E depicts an example of video replay mode. For example, configuration 700E may indicate a video replay type 760 (e.g., entire video replay, winning player reaction replay, losing player reaction replay, slow mode replay, final shot replay, etc.). Configuration 700E includes video 441. In an example embodiment, video 441 is edited or modified, based on video replay type 760. Configuration 700E further includes additional graphic 761. In an example embodiment, additional graphic 761 is a graphical chart of multi-player scores as time elapsed (e.g., a score vs. time line graph or plot). In other example embodiments, additional graphic 761 may be any of a player name, player avatar, high score award, historical scoring records, recommendations, tips, etc. Additional graphic 761 may be customized and/or modified by user device 120 and/or third-party application 370. In alternate embodiments, configuration 700E may include a plurality of additional graphics. Configuration 700E further includes control panel 750.

In particular example embodiments noted above (e.g., winning player reaction replay, losing player reaction replay, and final shot replay), video 441 is edited and modified by the game execution module 320 during generation of overlay video 515. For example, video replay options are selected, by the user, via third-party application 370. Upon selection of a video replay option, the game execution module 320 is configured to modify the overlay video 515 to incorporate the video replay option. More particularly, upon receipt of video 441, the game execution module 320 will modify a portion of the video 441 (e.g., the end of the video) to include a reduced video recording rate. In an example embodiment, game execution module 320 may identify a winning player as the timer is expiring (e.g., the player who has more points with a particular minimal time remaining). By identifying a winning player as the timer is expiring, the video 441 may be edited to focus on either the winning player and/or the losing player. Likewise, for example, as time is generally expiring, game execution module 320 may identify that the game is almost finished. By identifying that the game is almost finished, the video 441 may be edited to focus on the final moments (e.g., the last five seconds) of the game (e.g., the video 441 can be modified to slow mode for the final moments of the game). In an example embodiment, editing the video 441 includes reducing the video recording rate for a portion of the video 441 (e.g., the last 5% of the video), such that the end of the video is slow mode. In a different example embodiment, editing the video 441 includes recording the final portion of the game (e.g., the last ten seconds of the game as determined by the game timer managed by game execution module 320) at a different video recording rate. For example, the first fifty seconds of a sixty second game may be recorded at a first video recording rate (e.g., normal speed) whereas the last ten seconds of the sixty second game may be recorded at a second video recording rate (e.g., half speed).

Likewise, for example, as illustrated by FIG. 7F, the user device 120 displays configuration 700F. Configuration 700F includes view option 771. Through view option 771, the user may actively stream and display the overlay video 515 on the user device 120. Likewise, configuration 700F includes download option 772. Through download option 772, the user may download the overlay video 515 onto the user device 120, such that the overlay video 515 is physically stored on the user device 120. Configuration 700C further includes control panel 750.

The configurations explained above are merely example configurations. Additional configurations, beyond those illustrated in FIGS. 7A-F, may be implemented by user device 120 and/or third-party application 370. In an example embodiment, user device 120 may include display configurations. For example, the user may select the orientation and location of various graphical elements on the user device (e.g., horizontal component overlay, vertical component overlay, transparent overlay, etc.). In an example embodiment, user device 120 may include teaching/instruction mode. For example, the video 441 may include diagramming of proper shot form, dynamic analysis of the user's shot, recommendations regarding form improvement, critique, tips, etc. In an example embodiment, user device 120 may include slow mode. For example, the user may select the frame rate of video 441 to have a faster and/or slower video. There are a potentially endless number of configurations of user device 120 and third-party application 370 in communication with the electronic scoring system 110. Thus, the configurations described herein should not be construed as limiting in any way.

CONCLUSION

It should be understood that various changes and modifications to the example embodiments described herein will be apparent to those skilled in the art. Such changes and modifications can be made without departing from the spirit and scope of the present subject matter and without diminishing its intended advantages. It is therefore intended that such changes and modifications be covered by the appended claims.

What is claimed is:

1. A method of operating an electronic basketball scoreboard apparatus including an electronic scoring system having at least a processor, the method comprising the steps of:

transmitting a communication link to a user device from a data transmission module of the electronic scoring system to initiate the communication link with the user device before receiving at least one game parameter;

receiving, in the data transmission module from the communicatively coupled user device, the at least one game parameter;

operating, via the processor, a basketball game based on the received game parameter;

receiving, by the processor from a first score sensor, a first indication of a ball passing through a first basketball hoop affixed to a backboard having a camera;

receiving, by the processor from a second score sensor, a second indication of a ball passing through a second basketball hoop affixed to the backboard;

determining, via the processor, a first score of the basketball game based on the first indication from the first score sensor;

determining, via the processor, a second score of the basketball game based on the second indication from the second score sensor;

recording, via the camera, video of the basketball game;

generating, based on the first and second score, a graphical overlay and overlaying the graphical overlay onto the recorded video;

transmitting, from the data transmission module to the user device, the recorded video;

updating, in response to an indication from one of the first sensor and the second sensor, the graphical overlay; and transmitting, in real-time, from the data transmission module to the user device, the graphical overlay.

2. The method of claim 1, comprising the steps of:

operating, via the processor, a game timer for the basketball game;

determining, via the processor, an end of the basketball game based on the game timer;

recording a second recorded video containing one or more moments leading up to the end of the basketball game;

editing, via the processor, the second recorded video to play over a greater duration of time;

overlaying, via the processor, a winning graphic in a portion of the second recorded video corresponding to the first score sensor;

transmitting, from the data transmission module to the user device, the second recorded video including the winning graphic; and interrupting, in response to receiving the second recorded video, a playback of the recorded video.

3. The method of claim 1, further comprising the steps of:

operating, via the processor, a game timer for the basketball game;

identifying, by the processor, a most valuable player receiving, from the user device, an indication of a video replay option associated with the most valuable player;

generating, at a predetermined time prior to the game timer ending, a second recorded video including portions of the recorded video which include the most valuable player; and interrupting, automatically when the game timer ends, a playback of the recorded video and initiating playback of the second recorded video.

4. The method of claim 1, further comprising the steps of:

operating, via the processor, a game timer for the basketball game;

determining, via the processor, a first statistic based on the game timer and the first score;

determining, via the processor, a second statistic based on the game timer and the second score; and transmitting, from the data transmission module to the user device, the first statistic and the second statistic.

5. The method of claim 1, further comprising, before receiving the game parameter, transmitting, from the data transmission module to the user device, an application configured to enable user selection of the game parameter from among a plurality of game parameters.

6. The method of claim 5, wherein the application transmitted from the data transmission module is configured to display on the user device the recorded video, the first score, and the second score.

7. The method of claim 1, further comprising the steps of:

determining, via the processor, that the received game parameter includes a single-player game parameter; and disabling, via the processor, the second score sensor.

8. The method of claim 1, further comprising the steps of:

determining, via the processor, a first current score and a second current score of the basketball game;

determining, via the processor, at least one video frame of the recorded video that corresponds to the first and second current scores; and overlaying a graphical representation of the first and second current scores on the at least one video frame.

9. The method of claim 1, wherein the first and second scores are transmitted responsive to a change to at least one of the first and second scores.

10. A system for operating an electronic basketball scoreboard apparatus including an electronic scoring system and a processor, the processor executing the steps of:

transmitting, from a data transmission module of the electronic scoring system to a user device, a prompt signal to download an application configured to enable user selection of at least one game parameter;

receiving, in the data transmission module from the communicatively coupled user device, the at least one game parameter;

operating, via the processor, a basketball game based on the received game parameter;

receiving, by the processor from a first score sensor, a first indication of a ball passing through a first basketball hoop affixed to a backboard having a camera;

receiving, by the processor from a second score sensor, a second indication of a ball passing through a second basketball hoop affixed to the backboard;

determining, via the processor, a first score of the basketball game based on the first indication from the first score sensor;

determining, via the processor, a second score of the basketball game based on the second indication from the second score sensor;

recording, via the camera, video of the basketball game;

generate, based on the first and second score, a graphical overlay and overlaying the graphical overlay onto the recorded video;

transmitting, from the data transmission module to the user device, the recorded video;

updating, in response to an indication from one of the first sensor and the second sensor, the graphical overlay; and transmitting, in real-time, from the data transmission module to the user device, graphical overlay.

11. The method of claim 10, comprising the steps of:

operating, via the processor, a game timer for the basketball game;

determining, via the processor, an end of the basketball game based on the game timer;

recording a second recorded video containing one or more moments leading up to the end of the basketball game;

editing, via the processor, the second recorded video to play over a greater duration of time;

overlaying, via the processor, a winning graphic in a portion of the second recorded video corresponding to the first score sensor;

transmitting, from the data transmission module to the user device, the second recorded video including the winning graphic; and interrupting, in response to receiving the second recorded video, a playback of the recorded video.

12. The method of claim 10, further comprising the steps of:

operating, via the processor, a game timer for the basketball game;

identifying, by the processor, a most valuable player receiving, from the user device, an indication of a video replay option associated with the most valuable player;

generating, at a predetermined time prior to the game timer ending, a second recorded video including portions of the recorded video which include the most valuable player; and interrupting, automatically when the game timer ends, a playback of the recorded video and initiating playback of the second recorded video.

13. The method of claim 10, further comprising the steps of:

operating, via the processor, a game timer for the basketball game;

determining, via the processor, a first statistic based on the game timer and the first score;

determining, via the processor, a second statistic based on the game timer and the second score; and transmitting, from the data transmission module to the user device, the first statistic and the second statistic.

14. The method of claim 10, wherein the application transmitted from the data transmission module is configured to display on the user device, the recorded video, the first score, and the second score.

15. The method of claim 10, further comprising the steps of:

determining, via the processor, that the received game parameter includes a single-player game parameter; and disabling, via the processor, the second score sensor.

16. The method of claim 10, further comprising the steps of:

determining, via the processor, a first current score and a second current score of the basketball game;

determining, via the processor, at least one video frame of the recorded video that corresponds to the first and second current scores; and overlaying a graphical representation of the first and second current scores on the at least one video frame.

17. The method of claim 10, wherein the first and second scores are transmitted responsive to a change to at least one of the first and second scores.

18. An electronic basketball scoreboard apparatus, the apparatus having at least a processor which executes the steps of:

receiving, in a data transmission module from a communicatively coupled user device, available game parameters consisting of a game type selection and a time limit selection;

operating, via the processor, a basketball game based on the received game parameter;

receiving, by the processor from a first score sensor, a first indication of a ball passing through a first basketball hoop affixed to a backboard having a camera;

receiving, by the processor from a second score sensor, a second indication of a ball passing through a second basketball hoop affixed to the backboard;

determining, via the processor, a first score of the basketball game based on the first indication from the first score sensor;

determining, via the processor, a second score of the basketball game based on the second indication from the second score sensor;

recording, via the camera, video of the basketball game;

generate, based on the first and second score, a graphical overlay and apply it to the recorded video;

transmitting, from the data transmission module to the user device, the recorded video;

updating, in response to an indication from one of the first sensor and the second sensor, the graphical overlay; and transmitting, in real-time, from the data transmission module to the user device, the graphical overlay.

19. The method of claim 18, comprising the steps of:

operating, via the processor, a game timer for the basketball game;

determining, via the processor, an end of the basketball game based on the game timer;

recording a second recorded video containing one or more moments leading up to the end of the basketball game;

editing, via the processor, the second recorded video to play over a greater duration of time;

overlaying, via the processor, a winning graphic in a portion of the second recorded video corresponding to the first score sensor;

transmitting, from the data transmission module to the user device, the recorded video including the winning graphic; and interrupting, in response to receiving the second recorded video, a playback of the recorded video.

20. The method of claim 18, further comprising the steps of:

operating, via the processor, a game timer for the basketball game;

identifying, by the processor, a most valuable player receiving, from the user device, an indication of a video replay option associated with the most valuable player;

generating, at a predetermined time prior to the game timer ending, a second recorded video including portions of the recorded video which include the most valuable player; and interrupting, automatically when the game timer ends, a playback of the recorded video and initiating playback of the second recorded video.

* * * * *